US008035290B2

(12) United States Patent
Kato et al.

(10) Patent No.: US 8,035,290 B2
(45) Date of Patent: Oct. 11, 2011

(54) FLUORESCENT DISPLAY DEVICE AND CONDUCTIVE PASTE FOR THE FLUORESCENT DISPLAY DEVICE

(75) Inventors: Masahiro Kato, Chiba-ken (JP); Toshiyuki Misonou, Chiba-ken (JP); Masashi Miyagawa, Chiba-ken (JP)

(73) Assignee: Futaba Corporation, Chiba-Ken (JP)

( * ) Notice: Subject to any disclaimer, the term of this patent is extended or adjusted under 35 U.S.C. 154(b) by 352 days.

(21) Appl. No.: 12/232,203

(22) Filed: Sep. 12, 2008

(65) Prior Publication Data

US 2009/0085466 A1 Apr. 2, 2009

(30) Foreign Application Priority Data

Sep. 27, 2007 (JP) ..... 2007-251832

(51) Int. Cl.
*H01J 1/62* (2006.01)
*H01J 63/04* (2006.01)

(52) U.S. Cl. ..... 313/495; 313/496; 313/503; 313/331; 313/332; 313/346 R; 252/503

(58) Field of Classification Search ..... 313/495–503, 313/331, 332, 346 R; 252/503
See application file for complete search history.

(56) References Cited

U.S. PATENT DOCUMENTS 5,568,012 A * 10/1996 Mohri et al. ..... 313/517
5,643,034 A * 7/1997 Mohri et al. ..... 445/24
6,004,442 A * 12/1999 Choulga et al. ..... 204/416
6,525,468 B1 2/2003 Wada et al.

FOREIGN PATENT DOCUMENTS

JP 63-307643 12/1988
JP 2000-11929 1/2000
JP 2002-216680 8/2002
JP 2003-100240 4/2003
JP 2003-168381 6/2003

OTHER PUBLICATIONS

English language translation of JP 2002-216680.*
English language translation of JP 2003-100240.*

* cited by examiner

*Primary Examiner* — Nimeshkumar D. Patel
*Assistant Examiner* — Thomas A Hollweg
(74) *Attorney, Agent, or Firm* — Bacon & Thomas, PLLC

(57) ABSTRACT

A fluorescent display device includes an aluminum wiring layer formed on an insulating substrate; an insulating layer formed on the aluminum wiring layer, the insulating layer being provided with a through-hole disposed on the aluminum wiring layer; a conductive layer filled in the through-hole. The fluorescent display device further includes an anode conductor formed on the insulating layer to cover the conductive layer and a phosphor layer formed on the anode conductor. The conductive layer is formed of solid mixture containing aluminum and graphite.

14 Claims, 5 Drawing Sheets

FIG. 5

| EXAMPLE | | 1 | 2 | 3 | 4 | 5 | 6 | 7 | 8 | 9 | 10 |
|---|---|---|---|---|---|---|---|---|---|---|---|
| | | PRIOR ART | C=0.01% | C=0.1% | C=1.0% | C=2.0% | C=3.0% | C=5.0% | C=10.0% | C=20.0% | C=40.0% |
| COMPOSITION RATIO (wt%) | ALUMINUM POWDER | 80 | 79.992 | 79.92 | 79.2 | 78.4 | 77.6 | 76 | 72 | 64 | 48 |
| | GRAPHITE POWDER | 0 | 0.008 | 0.08 | 0.8 | 1.6 | 2.4 | 4 | 8 | 16 | 32 |
| | LOW-MELTING POINT | 20 | 20 | 20 | 20 | 20 | 20 | 20 | 20 | 20 | 20 |
| | | | | | | | | | | | |
| EVALUATION | BREAKDOWN VOLTAGE | 12 | 10 | 8 | 5V or less | 5V or less | 5V or less | 5V or less | 5V or less | 5V or less | 5V or less |
| | SURFACE RESISTANCE | 1 | 1 | 1 | 1.5 | 2 | 3 | 4 | 9 | 30 | 150 |
| | ELECTRICAL RESISTANCE | 2k~10M | 1k~10k | 1k | 500 | 350 | 350 | 350 | 400 | 450 | 500 |
| | HARDNESS | ◎ | ◎ | ◎ | ◎ | ○ | ○ | ○ | ○ | △ | △ |
| | OVERALL EVALUATION | × | ○ | ○ | ◎ | ◎ | ◎ | ◎ | ◎ | ◎ | ○ |

FLUORESCENT DISPLAY DEVICE AND CONDUCTIVE PASTE FOR THE FLUORESCENT DISPLAY DEVICE

FIELD OF THE INVENTION

This invention relates to a conductive layer connecting an aluminum wiring layer to an anode conductor in a fluorescent display device and conductive paste for use in forming the conductive layer.

BACKGROUND OF THE INVENTION

In a conventional fluorescent display device as shown in FIGS. 2 and 3, a glass substrate 3 serving as an insulating substrate, an aluminum wiring layer 7 and an insulating layer 9 are formed in that order from the bottom side. An anode conductor 13 is formed on the insulating layer 9 so that it can be electrically connected to the aluminum wiring layer 7 via a conductive layer 12.

The anode conductor 13 is formed by employing a thick film printing method by using, e.g., graphite paste mainly including graphite or aluminum paste mainly including aluminum. A phosphor layer 14 is formed on the anode conductor 13 by employing the thick film printing method using phosphor paste so that an anode 15 can be formed.

A grid electrode 16 is formed above anodes 15 to be fixed to the glass substrate 3 through a fixing electrode (not shown) which mainly includes Ag or Ag and Al. Filamentary cathodes 17 are provided above grid electrodes 16.

Japanese Patent Laid-open Application No. H7-20414 discloses a fluorescent display device, wherein the insulating layer 9 having a through-hole 11 is printed on the aluminum layer 7 formed on the glass substrate 3 by employing the thick film printing method and then cured at a temperature ranging from, e.g., 550 to 600° C. Then, the conductive layer 12 is formed by filling the through-hole 11 of the insulating film 9 with conductive paste which includes mainly Ag and low-melting point glass and to which an activator such as Zn, Sb or the like is added and then curing it at a temperature ranging from, e.g., 550 and 600° C. Resultantly, the oxide on the surface of an aluminum wiring layer 7 is removed and thus connection between the aluminum wiring layer 7 and the anode conductor 13 can be ensured.

On the other hand, Japanese Patent Laid-open Application No. 2000-11929 discloses a fluorescent display device which includes the aluminum wiring layer 7 formed on a glass substrate 3, the insulating film 9 having the through-hole 11 formed on a specific area of the aluminum wiring layer 7, the conductive layer 12 formed by filling the through-hole 11 with conductive paste including aluminum powder and at least either organic metal or low-softening point glass frit by employing the thick film printing method and then curing it, the anode conductor 13 formed on the conductive layer 12 and the phosphor layer 14 formed on the anode conductor 13.

Further, Japanese Patent Laid-open Publication No. 2006-85968 discloses a fluorescent display device where, for the purpose of ensuring electrical connection between the aluminum wiring layer 7 formed on the glass substrate 3 and an electrode for fixing a grid electrode 16, a junction layer, i.e. the conductive layer 12, of a graphite including frit glass or aluminum layer including frit glass, is formed in a through-hole 11 formed on a specific area of the aluminum wiring layer 7 and then cured to thereby prevent surface oxidation of the aluminum wiring layer 7.

The junction layer is formed by the paste prepared by mixing frit glass powder, a graphite powder and alumina powder filler in a vehicle. Alternatively, it is formed by the paste prepared by mixing aluminum powder and frit glass powder in a vehicle.

In the fluorescent display device including the conductive layer 12 which mainly includes Ag and low-melting point glass and to which an activator such as Zn, Sb or the like is added, electrical connection may not be achieved at an anode driving voltage of 12 V and further the aluminum thin film wiring layer 7 may be disconnected due to the influence of the activator such as Zn, Sb or the like, resulting in an insecure electrical connection in the conductive layer 12 in the through-hole 11.

Further, since the conventional conductive paste used for filling the through-hole 11 includes mainly Ag which is a different metal from the aluminum wiring layer 7, the through-hole 11 and the aluminum wiring layer 7 are incongruous.

Further, the conductive layer which includes mainly Ag and low-melting point glass and to which an activator such as Zn, Sb or the like is added costs more than an aluminum conductive layer.

There is a fluorescent display device where the anode conductor 13 and the aluminum wiring layer 7 are electrically connected via the conductive layer 12 containing aluminum powder and at least one of metal oxide in the form of glass obtained by heating metal forming organic metal and low-melting point glass.

In the above fluorescent display device, the resistance at the interfaces between the conductive layer 12, the anode conductor 13, the aluminum wiring layer after being exposed at a normal temperature and/or under humid conditions becomes unstable compare to the initial resistance by aluminum oxide produced by oxidation of aluminum forming the conductive layer 12.

In the conventional fluorescent display device where the conductive layer 12 is obtained by curing the paste prepared by mixing alumina powder serving as a filler in a vehicle in order to improve printing properties of the paste formed of graphite powder and frit glass powder serving as the anti-oxidation component for the aluminum surface, a voltage drop due to resistance of the conductive layer itself occurs because graphite is the only conductive material used.

Further, when the conductive layer 12 is formed by curing paste prepared by mixing aluminum powder and frit glass powder in a vehicle, a voltage drop can occur due to surface oxidation of the aluminum powder occurring after the curing.

SUMMARY OF THE INVENTION

The present invention provides a fluorescent display device capable of establishing a secure connection between an aluminum wiring layer and an anode conductor and to provide conductive paste for used in the improved fluorescent display device.

After an intensive research, the inventors of the present invention decided to make use of reducing power of graphite normally used in fluorescent display devices.

That is, the conductive layer filled in the through-hole in accordance with the present invention is mainly formed of solid mixture containing metal and graphite aluminum as a new conductive material so that electrical connection between the aluminum wiring layer and the conductive layer can be secured and further conductivity between the conductive layer and the graphite electrode can be maintained.

By employing conductive solid mixture formed by mixing aluminum and graphite in the present invention, the aluminum in the conductive layer is prevented from being oxidized by the reducing power of the graphite powder and interface connection between the conductive layer and the anode conductor becomes relatively stable compared to that in the conventional fluorescent display device.

Aspects of the present invention conceived based on the above investigation will be described hereinafter.

In accordance with an a first aspect of the present invention, there is provided a fluorescent display device includes an aluminum wiring layer formed on an insulating substrate; an insulating layer formed on the aluminum wiring layer, the insulating layer being provided with a through-hole disposed on the aluminum wiring layer; a conductive layer filled in the through-hole; an anode conductor formed on the insulating layer to cover the conductive layer; and a phosphor layer formed on the anode conductor.

The conductive layer is formed of solid mixture containing aluminum and graphite.

The conductive layer may be formed of solid mixture containing aluminum, graphite and low-melting point glass.

The conductive layer may be formed of solid mixture containing aluminum, graphite and metal oxide of metal selected from Ti, Zr and aluminum.

The conductive layer is preferably formed of the solid mixture which contains graphite in a range from 0.01 to 40 weight % of the total weight of aluminum and graphite of the solid mixture.

The conductive layer may be formed of the solid mixture which contains aluminum in a range from 99.99 to 60 weight % and graphite in a range from 0.01 to 40 weight % of the total weight of aluminum and graphite of the solid mixture.

The conductive layer may be formed of the solid mixture which contains graphite in a range from 0.01 to 40 weight % of the total weight of aluminum and graphite of the solid mixture and low-melting point glass in a range from 0.01 to 30 weight % of the total weight of aluminum, graphite and low-melting point glass of the solid mixture.

The conductive layer is preferably formed of the solid mixture which contain graphite in a range from 0.01 to 40 weight % of the total weight of aluminum and graphite of the solid mixture and metal oxide in a range from 4 to 14 weight % of the total weight of aluminum, graphite and metal oxide of metal selected from Ti, Zr and aluminum of the solid mixture.

If a very small amount of graphite is included in the total amount of the solid mixture of aluminum and graphite of the conductive layer filled in the through-hole for connecting the aluminum wiring layer and the anode conductor, the conductive layer mainly including aluminum and graphite, the object of the present invention can be achieved.

However, if there is too much graphite, resistance of the conductive layer itself increases due to relatively high resistivity of graphite as compared to aluminum, which can decrease connection strength between the aluminum wiring layer and the anode conductor.

Conductivity of aluminum is maintained and oxidation of the aluminum is prevented during high temperature curing by including graphite in an amount from 0.01 to 40 weight % of the total weight of the solid mixture forming the conductive layer.

Further, the conductive layer of the present invention contains low-melting point glass or oxide of metal selected from Ti, Zr and aluminum so that it can be firmly fixed to the aluminum wiring layer as well as to the anode electrode.

The object of the present invention can be attained without the low-melting point glass.

Further, too much low-melting point glass decreases fixation strength, whereas too little low-melting point glass causes a glass film to be formed and makes the electrical connection unstable. Therefore, the solid mixture of aluminum, graphite and low-melting point glass include low-melting point glass in an amount from 1 to 50 weight % and preferably in an amount from 5 to 25 weight %.

The solid mixture of the aluminum powder, graphite powder and low-melting point glass are mixed in a vehicle, i.e. a solution where cellulose is dissolved in a high boiling point solvent such as butyl carbitol or terpineol to thereby form paste.

The through-hole is filled with the paste by employing the thick film printing method and then cured at a high temperature in the atmosphere, thereby forming the conductive layer.

The solid mixture mainly including aluminum and graphite from which an organic material has been removed form part of the fluorescent display device.

In accordance with a second aspect of the present invention, there is provided a conductive paste for a fluorescent display device, comprising: a solid mixture including aluminum powder and graphite powder and a vehicle mixed with the sold mixture.

The solid mixture contains graphite in a range from 0.01 to 40 weight % of the total weight of aluminum and graphite in the solid mixture.

A solution of organic metal compounds which contains organic Ti compounds such as titanium octylene glycol, organic Zr compounds such as zirconium acetyl acetate or organic aluminum compounds such as aluminum isopropyl dissolved in an organic solvent such as butanol, acetyl acetone or triethanolamine may be used instead of the low-melting point glass.

In accordance with a third aspect of the present invention, there is provided a conductive paste for a fluorescent display device, including: a solid mixture including aluminum powder, graphite powder and low-melting point glass and a vehicle mixed with the solid mixture.

The solid mixture contains graphite in a range from 0.01 to 40 weight % of the total weight of aluminum and graphite in the solid mixture and low-melting point glass in a range from 0.01 to 30 weight % of the total weight of aluminum powder, graphite powder and low-melting point glass in the solid mixture.

In accordance with a fourth aspect of the present invention, there is provided a conductive paste for a fluorescent display device, including: a solid mixture including aluminum powder and graphite powder and a solution of organic metal compounds obtained by dissolving organic metal compounds selected from organic Ti, Zr and aluminum compounds into an organic solvent.

The solid mixture contains the graphite powder in a range from 0.01 to 40 weight % of the total weight of aluminum powder and graphite powder in the solid mixture.

In accordance with a fifth aspect of the present invention, there is provided a conductive paste for a fluorescent display device, including: a solid mixture including aluminum powder, graphite powder and low-melting point glass; a vehicle; and an organic metal compound solution obtained by dissolving one or more of organic Ti, Zr and Al compounds into an organic solvent.

The solid mixture contains the graphite powder in a range from 0.01 to 40 weight % of the total weight of aluminum powder and graphite powder in the solid mixture and low-melting point glass in a range from 5 to 25 weight % of the total weight of the solid mixture.

The aluminum powder, graphite powder and low-melting point glass mixed in a vehicle (i.e. a solution where cellulose is dissolved in a high boiling point solvent such as butyl carbitol or terpineol) to form paste, constitute solid mixture in the paste and also form the solid mixture in the conductive layer when the paste is cured in the atmosphere to thereby remove organic materials from the paste.

An organic material is removed from the organic metal which contains organic Ti compounds such as titanium octylene glycol, organic Zr compounds such as zirconium acetyl acetate or organic aluminum compounds such as aluminum isopropyl dissolved in an organic solvent such as butanol, acetyl acetone or triethanolamine by curing in the atmosphere, so that the conductive layer can be formed of the solid mixture containing the oxide of metal composing the organic metal.

In accordance with the aspects of the present invention, the conductive paste for the fluorescent display device is used as paste for filling a hole, i.e. for filling a through-hole to form a conductive layer so that a stable fluorescent display device can be provided at a low price without costly Ag.

Even in case of a fluorescent display device driven at a low anode supply voltage of 5 V or below, the fluorescent display device where electrical connection between an aluminum wiring layer and a grid electrode is stable when the aluminum wiring layer and the anode and grid electrodes are directly fixed on a glass substrate can be provided.

Since electrodes connected through the conductive layer of the present invention maintain their electrical connection by making use of the reducing power of graphite which prevents the surface oxidation of aluminum, the fluorescent display device capable of providing stable electrical connection between the aluminum wiring layer and any electrode mainly including graphite, Al or Ag can be obtained.

Further, since the conductive layer mainly includes aluminum and graphite, the fluorescent display device where the conductive layer matches well with the aluminum wiring layer and their electrical connection is stable can also be provided.

BRIEF DESCRIPTION OF THE DRAWINGS

The above and other objects and features of the present invention will become apparent from the following description of preferred embodiments given in conjunction with the accompanying drawings, in which:

FIG. 5 presents electrical resistance of the aluminum wiring and graphite electrode kept at a temperature of 85° C. for 120 hours.

DETAILED DESCRIPTION OF THE PREFERRED EMBODIMENTS

Hereinafter, embodiments of the present invention will be described in detail with reference to the accompanying drawings which form a part hereof.

Figure 1:
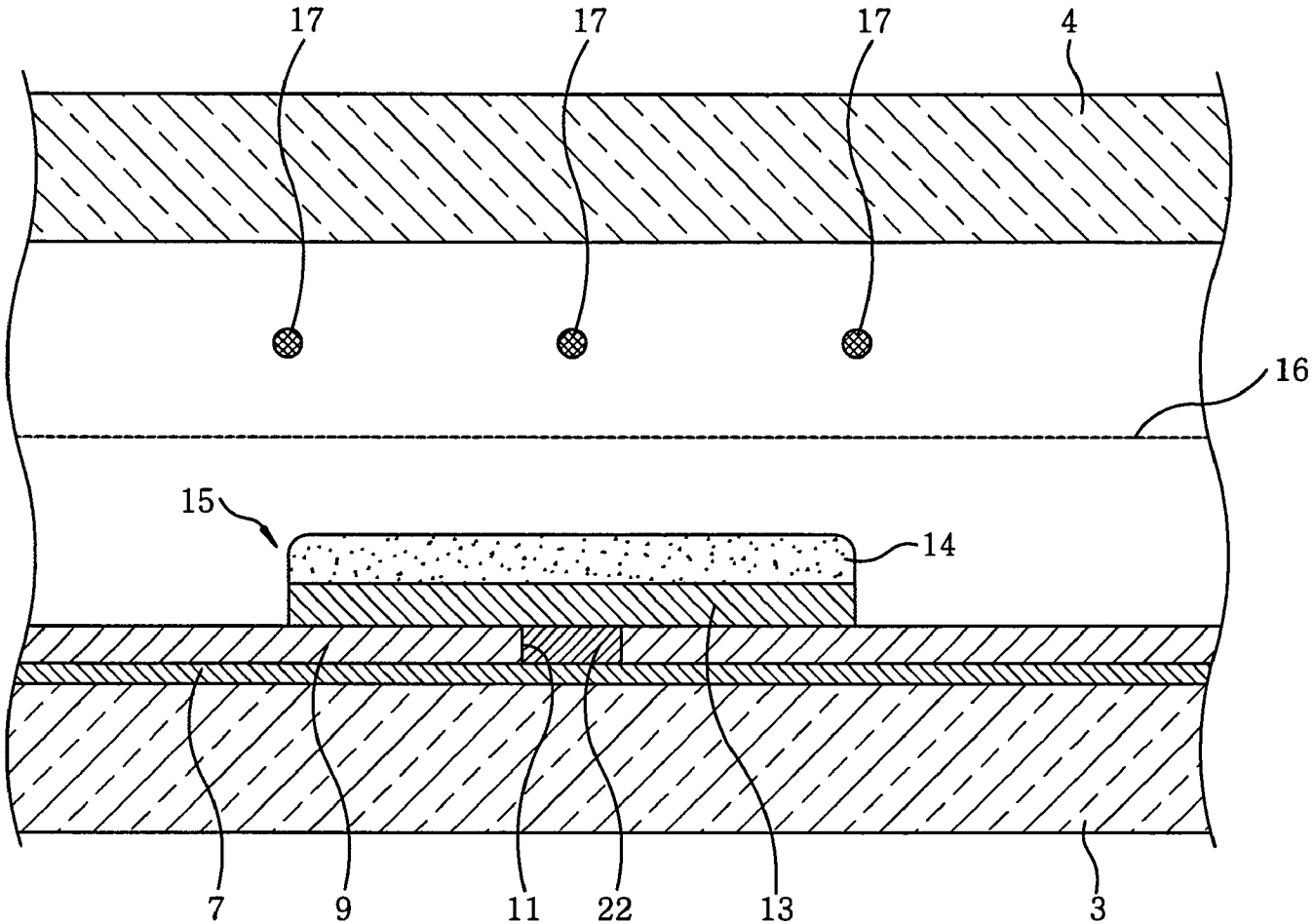
FIG. 1 is a partial enlarged cross-sectional view of a fluorescent display device of the present invention.

In a fluorescent display device 1 shown in FIG. 1 in accordance with an embodiment of the present invention, conductive paste for the fluorescent display device which is used to form a conductive layer 22 filled in a through-hole 11 and the conductive layer 22 obtained by curing the conductive paste for the fluorescent display device are different from the conventional ones. An aluminum thin film is used as a wiring layer, which is connected to an anode conductor 13 via the conductive layer 22 filled in the through-hole 11.

The conductive layer 22 which has conductivity by conductive solid mixture including aluminum powder and graphite powder and of which fixation strength is increased by at least one of low-melting point glass and oxide of metal forming organic metal compounds can be obtained.

An anode conductor 13 of the fluorescent display device 1 of the present embodiment is mainly formed of graphite powder.

A phosphor 14 which emits light upon electron excitation is coated on the top surface of the anode conductor 13.

A grid electrode 16 of a mesh-like thin metal plate is formed above the phosphor 14 and is electrically connected and fixed to an insulating substrate 3 by the conductive material mainly including Ag or Ag and Al in the through-holes of the insulating layer 9.

The aluminum powder may be obtained by nitrogen-atomizing, i.e. by injecting liquid aluminum into a nitrogen atmosphere to get fine powder. Fine powder within a range from 1 to 10 μm and preferably 2 to 5 μm in average particle diameter may be used as the aluminum powder. The nitrogen-atomized aluminum powder allow an oxidation reaction to occur at about 540° C. leading to breakage of an oxide film on the surface of the aluminum powder and an oxide film on the aluminum wiring layer 7, thereby ensuring satisfactory electrical connection. Further, since the reaction is kept from excessively proceeding even when curing is repeated at a temperature within a range from 550 to 600° C., the particles are preferable as a material for the conductive layer capable of securing electrical connection between the aluminum thin film wiring layer 7 and the anode conductor 13.

The aluminum powder as the main ingredient of the conductive paste for the fluorescent display device are used together with graphite powder in the present embodiment and it is considered that the graphite powder serves as the oxidation inhibitor of the aluminum surface when it is cured at a temperature within a range from 550 to 600° C. Aluminum powder available in the market may be used to achieve the desired results of the embodiment of the present invention.

While graphite powder available in the market may be used, flake-type graphite powder with an average particle diameter ranging from 1 to 5 μm is preferable and flake-type graphite powder with an average particle diameter ranging from 2 to 4 μm are more preferable. The low-softening point glass frit used to form the conductive paste for the fluorescent display device in the present embodiment is glass with a softening point ranging from 300 to 400° C. such as PbO based glass, SnO—$P_2O_5$ based glass, $Bi_2O_3$ based glass or the like.

The vehicle contained in the conductive paste for the fluorescent display device is required for screen printing of the conductor in a predetermined pattern and it is removed from a viscous liquid where organic high-molecular substances are dissolved in an organic solvent during curing.

In the present embodiment, it is preferable to use a vehicle prepared by dissolving ethyl cellulose in ethylene glycol.

Further, the vehicle and solution of organic metal compounds contained in the conductive paste for the fluorescent display device are removed during curing at a temperature within a range from 550 to 600° C. in the atmosphere so that the conductive layer made of solid mixture such as graphite, metal, metal oxide, ceramic, glass and the like can be formed.

In order to improve printing properties and characteristics, an oxide filler may be mixed in the conductive paste as a filling material. Lead titanate particles, zirconium oxide particles or ceramic particles are preferable as the oxide filler.

Paste formed by mixing the solid mixture of aluminum powder and graphite powder, a solution of the organic metal compounds where the organic Ti compounds are dissolved in butanol and the vehicle may be used.

Further, the paste may also be formed by mixing the compounds of aluminum powder and graphite powder, the low-softening point glass frit, the solution of the organic metal compounds where the organic Ti compounds are dissolved in butanol and the vehicle.

Next, examples of paste composition of the present embodiment, i.e. paste (1), paste (2) and paste (3) will be described.

The paste (1) is formed by mixing solid mixture of aluminum powder, graphite powder and low-softening point glass frit in a vehicle prepared by dissolving ethyl cellulose in ethylene glycol.

Solid mixture of 78 g as a conductive material is obtained by mixing aluminum powder of 75 g and graphite powder of 3 g. Here, the aluminum powder and the graphite powder are in the weight ratio of 96.1:3.9.

The solid mixture of 78 g are formed by mixing aluminum particles of 75 g and graphite powder of 3 g. Further, the solid mixture of 78 g and SnO—$P_2O_5$ based glass of 22 g form solid mixture of total 100 g. Here, the aluminum powder, the graphite powder and the SnO—$P_2O_5$ based glass are in the weight ratio of 75:3:22.

The paste is formed by mixing the total solid mixture of 100 g and the vehicle of 100 g.

That is, the paste is formed of the total solid mixture and vehicle in the weight ratio of 50:50.

Considering printing properties, resistance after curing and fixation strength, it is preferable to use the paste where the total solid mixture range from 30 to 70 weight % and the vehicle ranges from 70 to 30 weight %.

Further, zirconium oxide particles may be added as a filling material.

The paste (2) is formed by mixing mixture of aluminum powder and graphite powder in a solution of organic metal compounds.

Solid mixture of 100 g is obtained by mixing aluminum of 97 g and graphite powder of 3 g. The paste is made by mixing such solid mixture of 70 g and a solution of organic Ti compound of 30 g prepared by dissolving titanium octylene glycol as the organic Ti compound into triethanolamine.

In this way, the conductive paste for the fluorescent display device is prepared by mixing 70 weight % solid mixture, which is 97 weight % aluminum powder and 3 weight % graphite powder, and 30 weight % organic Ti compound solution, which is formed by dissolving titanium octylene glycol as the organic Ti compounds into triethanolamine.

While the amount of the organic Ti compound solution relative to the total weight of the paste can be varied in order to adjust the printing properties, it preferably ranges from 30 to 70 weight % if the printing properties, resistance after curing and fixation strength are considered.

An organic metal solution prepared by dissolving an organic Zr compound, such as zirconium acetyl acetate, or an organic aluminum compound, such as aluminum isopropyl, instead of the organic Ti compound, such as titanium octylene glycol or the like, in an organic solvent such as butanol, acetyl acetone or triethanolamine, may be added to the paste.

Zirconium oxide particles may be added as a filling material.

The paste (3) is formed by mixing SnO—$P_2O_5$ based glass, a solution of organic Ti compound and a vehicle with a mixture of aluminum powder and graphite powder.

Solid mixture of 100 g is obtained by mixing aluminum powder of 76 g, graphite powder of 3 g, SnO—$P_2O_5$ based glass of 16 g and lead titanate of 5 g. Here, the aluminum powder, graphite powder, SnO—$P_2O_5$ based glass and lead titanate particles are in the weight ratio of 76:3:16:5.

The solid mixture of 30 to 70 weight % are mixed with an organic Ti compound ranging from 35 to 15 weight %, which is formed by dissolving titanium octylene glycol as the organic Ti compound into triethanolamine, and a vehicle ranging from 35 to 15 weight %, thereby forming the conductive paste 3 for the fluorescent display device.

An organic Zr compound or an organic aluminum compound may be used instead of the organic Ti compound.

EXAMPLE 1

Fluorescent Display Device Whose Conductive Layer 22 is Formed of the Paste (1)

FIG. 1 is a partial cross-sectional view of a fluorescent display device 1 whose conductive layer 22 is formed by curing the paste (1) for the fluorescent display device as hole-filling paste.

Figure 2:
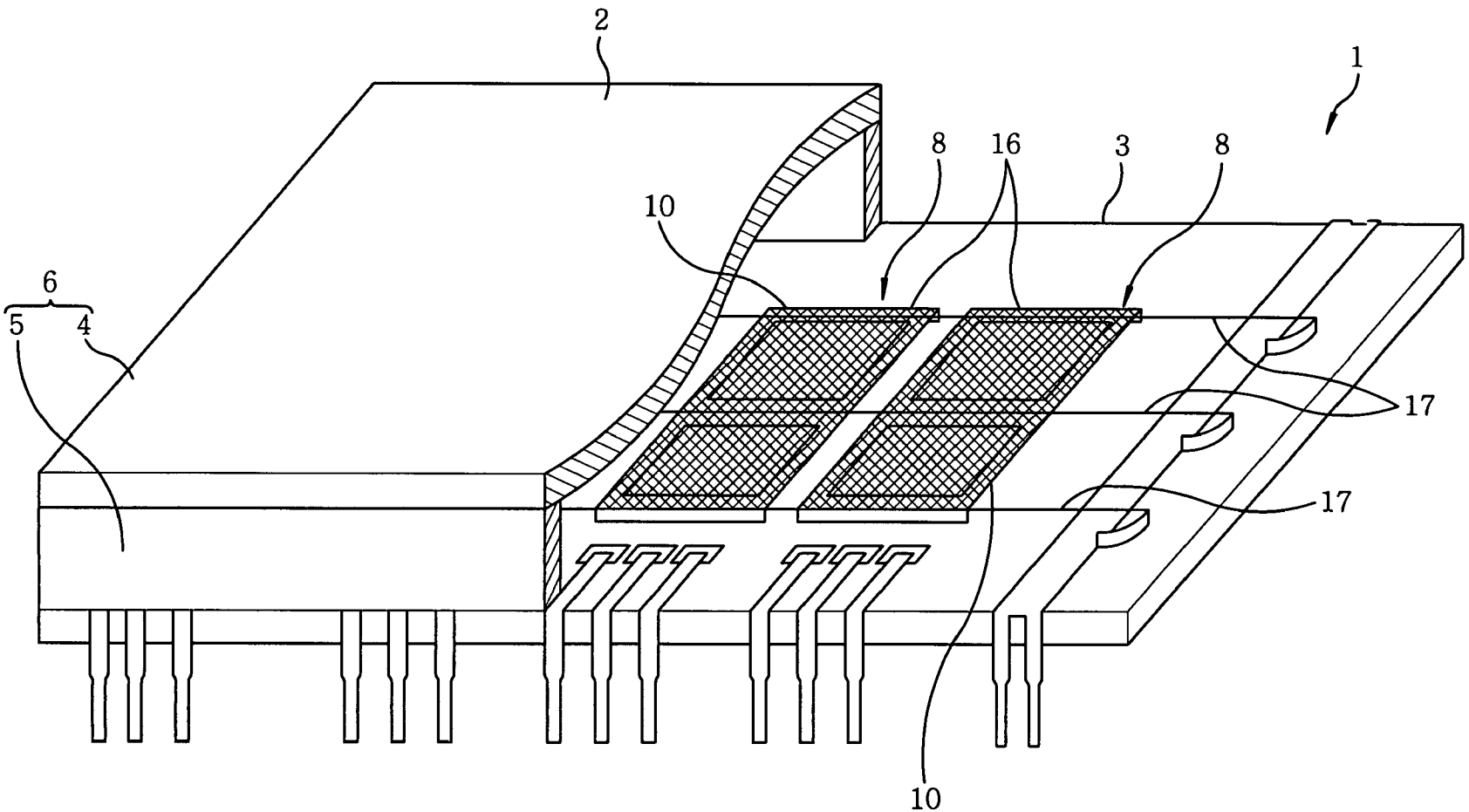
FIG. 2 is a sectional perspective view of a conventional fluorescent display device.
Figure 3:
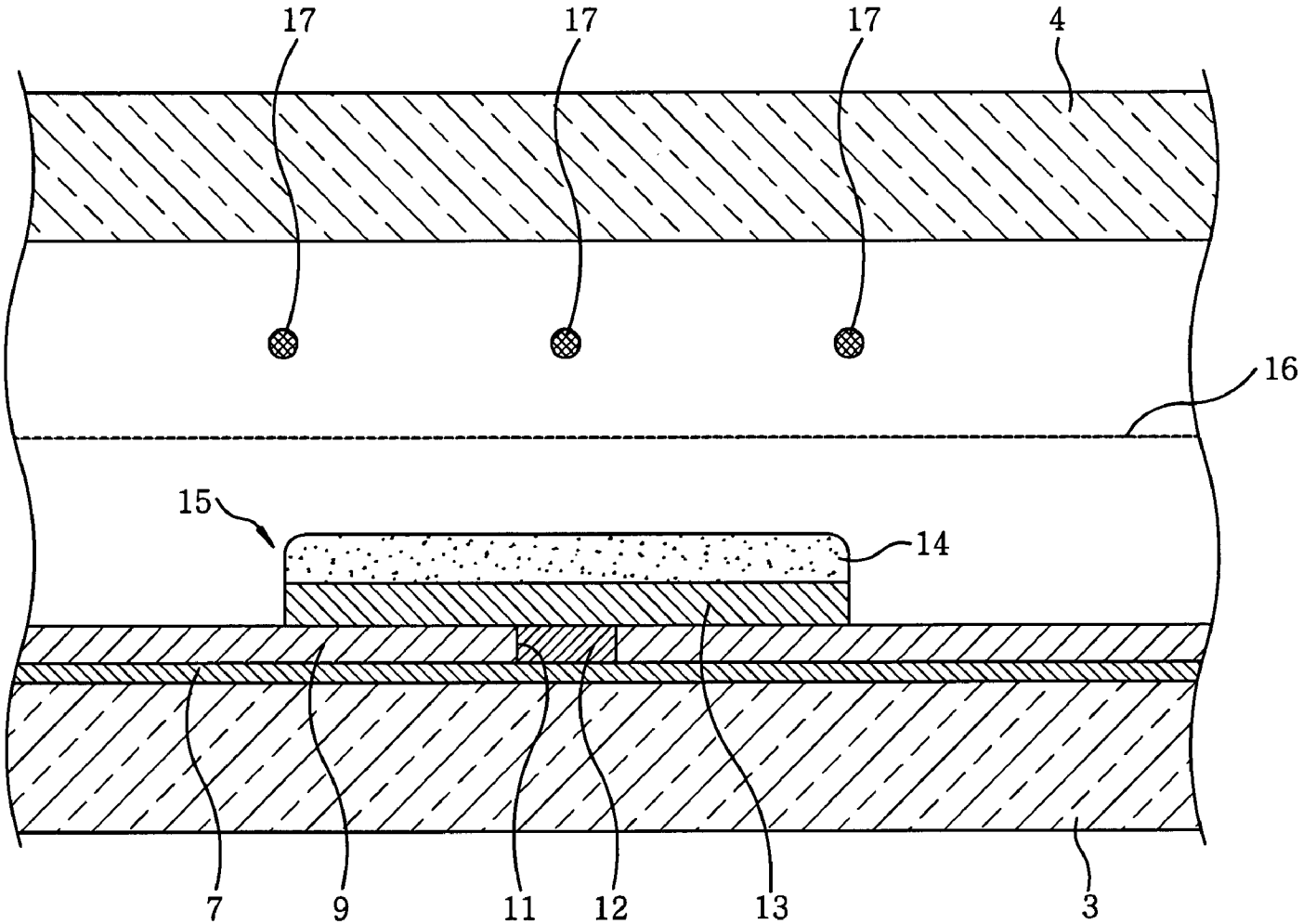
FIG. 3 is a partial enlarged cross-sectional view of the conventional fluorescent display device of FIG. 2.

As shown in FIG. 2, the fluorescent display device 1 has an airtightly sealed housing 2 of a box shape which is maintained at a high vacuum state. The housing 2 includes an insulating anode substrate 3 and a lid-shaped casing 6 formed of an insulating and light transmitting front plate 4 and a frame-shaped insulating side plate 5. The substrate 3 and plates 4 and 5 of the housing 2 are made of glass.

The casing 6 is sealed at the peripheral edges of the anode substrate 3 with a sealing member, evacuated and then sealed so that the inside can be maintained at a high vacuum state.

As shown in FIGS. 1 and 2, the aluminum wiring layer, i.e., the anode wiring layer and grid wiring layer 7, is formed in a predetermined pattern on the anode substrate 3 by using a conductive material of a thin aluminum film. The above-described conductive paste for the fluorescent display device is printed inside the through-hole 11 of the insulating layer 9 in each segment 10 to fill the through-hole 11, thereby forming the conductive layer 22.

At the same time, the conductive paste for the fluorescent display device described above is printed in the through-holes positioned at connection points between the grid electrodes 16 and the grid wiring layer (not shown) and then dried.

Then, the insulating layer 9 serving as a second layer is formed by printing and then cured at a temperature within a range from 550 to 600° C. in the atmosphere. Organic substances are removed by the curing to thereby form the conductive layer 22.

Subsequently, graphite paste prepared by mixing graphite and a vehicle is printed in the form of each segment 10 and cured in the atmosphere, resulting in the anode conductor 13 mainly including graphite.

Then, phosphor paste formed by mixing phosphor powder and a vehicle is printed on the anode conductor 13 after a display pattern 8 of each segment 10 and cured in the atmosphere to thereby form the phosphor layer 14.

Although aluminum is employed instead of graphite as a main component of the conductive material of the solid mixture forming the anode conductor 13, the same effects as those of the anode conductor mainly including graphite can be obtained because the conductive layer of the present invention also contains aluminum.

A mesh-like grid 16 is arranged above the display pattern 8 in the housing 2. The mesh-like grid is connected to the wiring layer 7 through the conductive layer 22 filled in the through-hole and fixed to the anode substrate 3 through a fixing electrode mainly including Ag.

The fixing electrode may be made of solid mixture of Al and Ag.

Separately from the above-described operation, a frame with filamentary cathodes 17 is formed. The periphery of the bottom surface of the side plate 5 of the casing 6 is positioned on an outer periphery of the anode substrate 3 which is coated with low-melting point glass paste. The anode substrate 3 and casing 6 are vertically pressed against each other, and the outer periphery of the anode substrate 3 and the casing 6 are sealed to each other at a temperature of 500° C. or below, so that the housing 2 can be assembled. If the housing 2 is then evacuated to a high vacuum and sealed, the fluorescent display device 1 is completed.

The filamentary cathodes 17 facing the display pattern 8 are uniformly arranged above the display pattern 8 in the housing 2.

The phosphor is excited to emit light by electrons generated by heating the cathodes 17.

In this example, since both the conductive layer 22 filled in the through-hole 11 and the aluminum wiring layer 7 include mainly aluminum, the conductive layer 22 matches well with the aluminum wiring layer 7 and further desired electrical connection between the aluminum wiring layer 7 and the anode conductor 13 is achieved.

Graphite in the mixture of aluminum powder and graphite powder acts as an oxidation inhibitor of the aluminum surface when the conductive paste for the fluorescent display device of the present invention is cured at a temperature within a range from 500 to 600° C. Further, the conductive layer 22 formed by curing the conductive paste for the fluorescent display device and the anode electrode 15 are electrically well connected because oxidation of the aluminum surface at the interface therebetween is prevented.

The anode electrode 15 with the anode conductor 13 mainly made of graphite and the fixing electrode of the grid electrode mainly made of Ag are electrically well connected. Therefore, any defects can be suppressed even when a voltage of 5 V is applied to the anode and grid electrodes.

The conductive layer 12 of this example mainly includes aluminum and graphite so that stable resistance can be obtained with low cost compared to the conductive layer mainly including Ag. Since Ag is not used, lower-priced fluorescent display devices can be provided.

COMPARATIVE EXAMPLE 1

To Test Effects of the Example 1

It was confirmed in the example 1 that stable connection between the aluminum wiring layer 7 and the anode electrode 15 was obtained by the conductive layer 22 mainly including aluminum powder and graphite powder. Further, the effects in graphite of the conductive layer 22 were revealed as will be described.

In the conductive paste for the fluorescent display device of the example 1, the solid mixture was made of the aluminum powder, graphite powder, SnO—$P_2O_5$ based glass and filling material in the weight ratio of 76:3:16:5.

The conductive paste for the fluorescent display device was then formed of the solid mixture ranging from 30 to 70 weight % and the vehicle ranging from 70 to 30 weight %.

An anode substrate sample A was prepared by filling the through-hole of the anode substrate on which the aluminum wiring layer was formed with the above conductive paste for the fluorescent display device and curing it.

On the other hand, solid mixture of aluminum powder, SnO—$P_2O_5$ based glass and a filling material in the weight ratio of 76:16:8 were formed.

Then, by mixing the solid mixture in a range from 30 to 70 weight % and the vehicle in a range from 70 to 30 weight %, conductive paste for the fluorescent display device without graphite was prepared.

An anode substrate sample B was prepared by filling the through-hole of the anode substrate on which the aluminum wiring was formed with the above conductive paste for the fluorescent display device and curing it.

Figure 4:
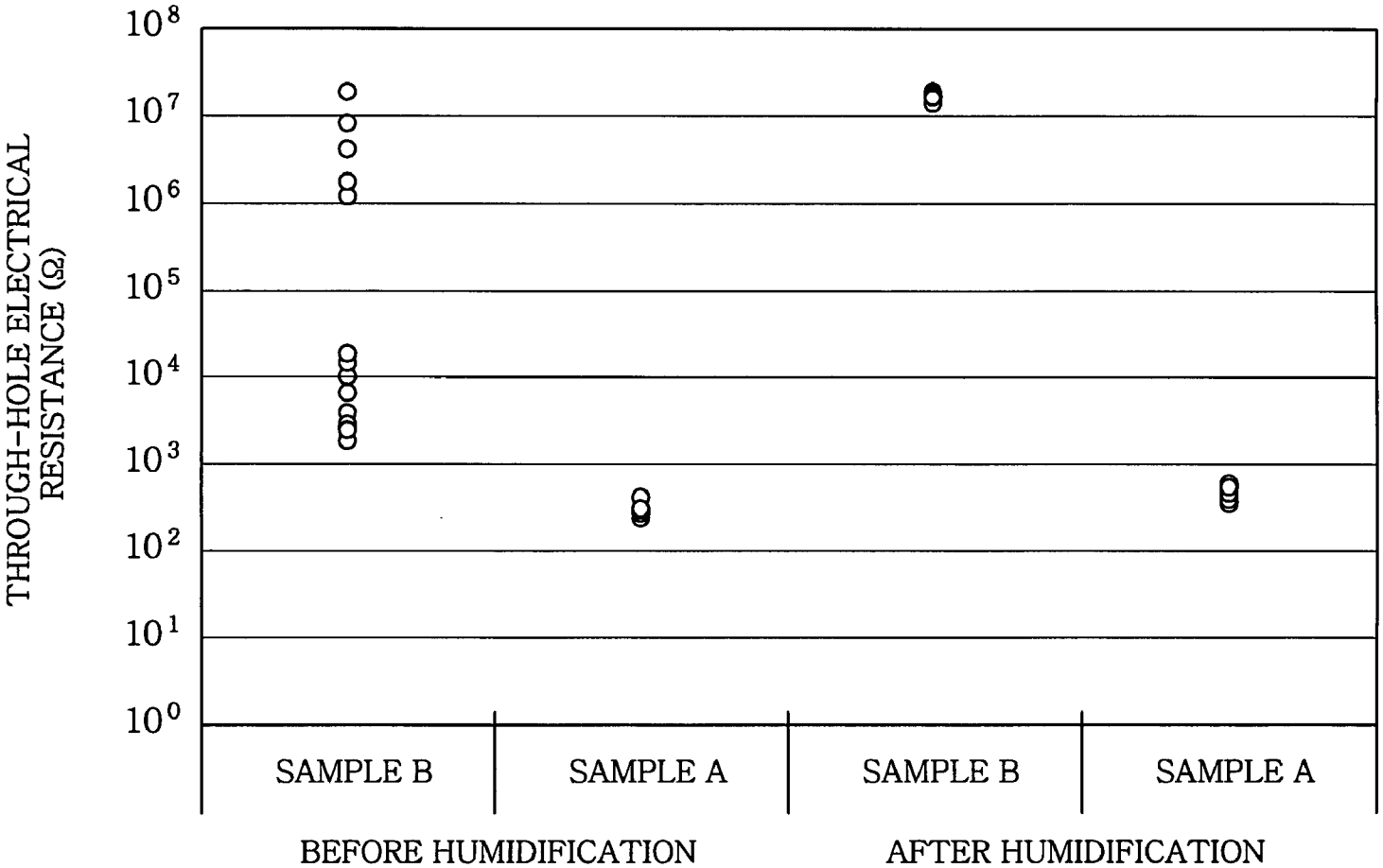
FIG. 4 is a graph showing electrical resistance of the aluminum wiring and graphite electrode of the samples A and B.

FIG. 4 shows electrical resistance of the aluminum wiring and graphite electrode (anode electrode 15) of the samples A and B before and after the humidification process at 85° C. for 120 hours. In FIG. 4, resistance of the sample A was maintained at several hundreds of Ω before and after the humidification process. From this result, it is noted that the conductive layer 22 filled in the through-hole of the fluorescent display device of the present invention was preferably stable.

On the contrary, resistance of the sample B before the humidification process ranged from several kΩ to several tens of MΩ, which showed that the sample B was not preferable as the conductive layer to be filled in the through-hole of the fluorescent display device. Further, since the resistance was over several tens of MΩ after the humidification process, it is noted that the sample B was not preferable as the conductive layer to be filled in the through-hole of the fluorescent display device.

As described above, by forming the conductive layer filled in the through-hole for connecting the aluminum wiring layer and the graphite electrode with aluminum powder and graphite powder as a main ingredient, stable electrical connection between the aluminum wiring layer and the graphite electrode can be provided in accordance with the present invention.

COMPARATIVE EXAMPLE 2

To Test the Added Amount of Graphite Powder

The effects of the added amount of graphite to the total amount of the solid mixture of aluminum and graphite were examined as follows.

The above solid mixture of aluminum powder and graphite, and SnO—$P_2O_5$ based glass were mixed to be solid mixture in the weight ratio 80:20. The solid mixture of aluminum powder and graphite powder was formed by varying the added amount of graphite to the total amount of the solid mixture of aluminum powder and graphite powder in a range from 0.01 to 40 weight %.

The solid mixture formed of the SnO—$P_2O_5$ based glass, aluminum powder and graphite powder and a vehicle in the weight ratio of 50:50 were mixed.

Therefore, conductive paste for the fluorescent display device was prepared by mixing the solid mixture and the vehicle.

The through-hole of the anode substrate was filled with the above-described conductive paste for the fluorescent display device instead of the conductive paste for the fluorescent display device applied in the example 1 and then heated and cured at a temperature within a range from 550 to 600° C. in the atmosphere to thereby form an anode substrate with a conductive layer 22.

Electrical resistance of the aluminum wiring and graphite electrode of the above anode substrate kept at a temperature of 85° C. for 120 hours is shown in FIG. 5.

The terms in FIG. 5 are described as follows.

(1) The breakdown voltage is a voltage for making the display stable by applying a voltage to the anode and grid electrodes while the completed fluorescent display device to which a predetermined filament voltage is applied emits thermal electrons. Its unit is the volt V.

(2) The surface resistance refers to surface resistance of the conductive layer formed by applying paste where the composition ratio of aluminum, powder and graphite powder is changed to the glass substrate and then curing it. Its unit is the ohm Ω.

(3) The conduction resistance refers to resistance between the aluminum layer and the electrode mainly including graphite connected via the conductive layer formed by filling the through-hole with paste where the composition ratio of aluminum powder and graphite powder is changed and curing it. Its unit is kilo-ohms kΩ.

(4) The hardness is examined by scratching the conductive layer with an HB pencil, the conductive layer being formed by applying paste where the composition ratio of aluminum powder and graphite powder is changed to the glass substrate and then curing it. If the hardness is the same as that of the conventional conductive layer which does not contain graphite, it is indicated as ◎. If the hardness is a little less than that of the conventional conductive layer which does not contain graphite but the conductive layer functions well, it is indicated as ○. If the hardness is less than that of the conventional conductive layer which does not contain graphite but the conductive layer functions well, it is indicated as Δ.

(5) The overall evaluation is to assess the conductive layer 22 filled in the through-hole of the fluorescent display device by the weight ratio of carbon in the solid mixture of aluminum powder and graphite powder considering the evaluation of (1) to (4).

As shown in FIG. 5, the breakdown voltage was reduced from 12 V to 10 V when the graphite powder of only 0.01 weight % was contained in the solid mixture composed of aluminum powder and graphite powder. Further, the electrical resistance was significantly reduced from between 2 kΩ and 10 MΩ to between 1 kΩ and 10 kΩ by the conductive layer connecting the aluminum wiring and the anode mainly including graphite.

Further, the hardness of the conductive layer was high enough to be used in the fluorescent display device. According to the overall evaluation of the conductive layer 22 filled in the through-hole of the fluorescent display device by the weight ratio of carbon in the solid mixture of aluminum powder and graphite powder considering the evaluation of (1) to (4), the composition ratio of carbon in a range from 1.0 to 10 weight % is preferable.

Further, the composition ratio of aluminum of the solid mixture forming the conductive layer to the total weight of aluminum and graphite ranges from 99.9 to 60 weight %. If carbon exceeded 40 weight %, the surface resistance increased significantly, which made the connection resistance unstable.

In case of the carbon in a range from 0.01 to 0.1 weight %, the breakdown voltage ranged from 10 to 8 V, which was stable compared to that of the conventional conductive layer 12.

COMPARATIVE EXAMPLE 3

To Test the Added Amount of Low-Melting Point Glass

The effects of the added amount of low-melting point glass to the total amount of the solid mixture of aluminum and graphite were examined as follows.

The added amount of graphite to the total amount of the solid mixture of aluminum powder and graphite powder was 3 weight %, which was kept as a constant. The composition ratio of SnO—$P_2O_5$ based glass to the total solid mixture formed of aluminum powder, graphite powder and SnO—$P_2O_5$ based glass was in a range from 0.01 to 30 weight %. The above solid mixture and a vehicle were then mixed in a ratio of 50:50 weight %. Then, conductive paste for the fluorescent display device was prepared by mixing the mixture.

The through-hole of the anode substrate was filled with the above conductive paste for the fluorescent display device instead of the conductive paste for the fluorescent display device applied in the example 1 and then heated and cured at a temperature within a range from 550 to 600° C. in the atmosphere, whereby an anode substrate with a conductive layer 22 was formed.

As a result, the conductive layer 22 containing SnO—$P_2O_5$ based glass in the range from 0.01 to 30 weights of the total solid mixture was provided with fine fixation strength and conductivity.

It is found that it is preferable to have the composition ratio of SnO—$P_2O_5$ based glass in the conductive layer to be set in a range from 5 to 25 weight %. If it is in a range from 0.01 to 5 weight %, fixation strength is not good enough. On the other hand, if it ranges from 25 to 30 weight %, conductivity is reduced.

By using a solution of organic metal compounds with or instead of low-melting point glass such as SnO—$P_2O_5$ based glass or the like as a fixing material, metal oxide of metal forming the organic metal compounds in the form of glass can fix the conductive material.

If the solution of organic metal compounds is cured at a temperature within a range from 550 to 600° C., it can be used as a fixing material formed of glass-type Ti, Zr or aluminum oxide.

EXAMPLE 2

Fluorescent Display Device Whose Conductive Layer is Formed of Aluminum Powder, Graphite Powder and Glass-Type Ti Oxide Instead of the conductive paste (1) for the fluorescent display device used in the example 1, the paste (2) was used for the fluorescent display device.

Solid mixture was formed by mixing aluminum powder of 97 g and graphite powder of 3 g. Then, the conductive paste for the fluorescent display device was formed by mixing the solid mixture of aluminum powder and graphite powder of 70 weight % and a solution of organic Ti compounds of 30 weight % prepared by dissolving titanium octylene glycol as the organic Ti compounds into triethanolamine. The conductive layer 22 was then formed by using glass-type Ti oxide as a fixing material obtained by curing the conductive paste for the fluorescent display device at a temperature within a range from 550 to 600° C.

Here, the aluminum powder, graphite powder and glass-type Ti oxide of the conductive layer were in the weight ratio of 91.5:2.8:5.7.

When a voltage of 5 V was applied to the anode and grid electrodes of the fluorescent display device having the conductive layer and a predetermined voltage was applied to the filament, the phosphor of the fluorescent display device emitted light stably upon electron excitation.

If Ti oxide of the conductive layer was less than 4 weight %, fixation strength was reduced. In contrast, if it was more than 14 weight %, viscosity of the paste was reduced, and therefore the utility of printing properties was deteriorated. Accordingly, it is concluded that it is preferable when metal oxide of the organic metal compounds such as Ti oxide or the like in the conductive layer is in a range from 4 to 14 weight %.

EXAMPLE 3

Fluorescent Display Device Whose Conductive Layer was Formed of Aluminum Powder, Graphite Powder, Glass-Type Ti Oxide, SnO—$P_2O_5$ Based Glass and a Filling Material Instead of the conductive paste (1) in the example 1, the paste (3) was used for the fluorescent display device.

Solid mixture of 100 g were formed by mixing aluminum powder of 96 g, graphite powder of 3 g, SnO—$P_2O_5$ based glass of 16 g and Zr oxide particles of 5 g.

The solid mixture of 70 g, a solution of organic Ti compounds of 20 g as a liquid to form the paste prepared by dissolving titanium octylene glycol as the organic Ti compounds into triethanolamine, and a vehicle of 10 g were mixed. Then, they were kneaded to form the conductive paste for the fluorescent display device.

The fluorescent display device was then formed by using the conductive paste for the fluorescent display device. The conductive paste for the fluorescent display device was cured at a temperature within a range from 550 to 600° C. and thereby the conductive layer was formed by using a fixing material made of low-melting point glass and glass-type Ti oxide.

Here, the aluminum powder, graphite powder, SnO—$P_2O_5$ based glass, filling material and Ti oxide of the conductive layer were in the weight ratio of 73:3:15:5:4.

When the conductive layer, the aluminum wiring layer, the anode electrode mainly including graphite and the grid electrode formed through the aluminum wiring layer and the grid fixing electrode mainly containing graphite were prepared, if a voltage of 5 V was applied to the grid and anode electrodes and a predetermined voltage was applied to the filament, the phosphor emitted light stably upon electron excitation.

In accordance with the present invention, a fluorescent display device capable of obtaining stable electrical and mechanical connection among the aluminum wiring layer, the anode conductor and the grid electrode by providing the conductive layer mainly including aluminum and graphite without Ag and filled in the through-hole is provided. Therefore, a reliable fluorescent display device is provided at a low price.

While the invention has been shown and described with respect to the preferred embodiments, it will be understood by those skilled in the art that various changes and modifications may be made without departing from the spirit and scope of the invention as defined in the following claims.

What is claimed is:

1. A fluorescent display device comprising: an aluminum wiring layer formed on an insulating substrate; an insulating layer formed on the aluminum wiring layer, the insulating layer being provided with a through-hole disposed on the aluminum wiring layer; a conductive layer filled in the through-hole; an anode conductor formed on the insulating layer to cover the conductive layer; and a phosphor layer formed on the anode conductor, wherein the conductive layer is formed of a solid mixture containing aluminum and graphite, wherein the aluminum is prevented from being oxidized by the graphite serving as a reducing agent for the aluminum, and wherein the conductive layer is formed of the solid mixture which contains aluminum in a range from 99.99 to 60 weight % and graphite in a range from 0.01 to 40 weight % of the total weight of aluminum and graphite of the solid mixture.

2. The fluorescent display device of claim 1, wherein the conductive layer is formed of solid mixture containing aluminum, graphite and low-melting point glass.

3. The fluorescent display device of claim 2, wherein the conductive layer is formed of the solid mixture which contains graphite in a range from 0.01 to 40 weight % of the total weight of aluminum and graphite of the solid mixture and low-melting point glass in a range from 0.01 to 30 weight % of the total weight of aluminum, graphite and low-melting point glass of the solid mixture.

4. The fluorescent display device of claim 2, wherein the amount of the low-melting point glass is in the range from 5 to 25 weight % of the total weight of the solid mixture.

5. The fluorescent display device of claim 1, wherein the conductive layer is formed of solid mixture containing aluminum, graphite and metal oxide of metal selected from Ti, Zr and aluminum.

6. The fluorescent display device of claim 5, wherein the conductive layer is formed of the solid mixture which contains graphite in a range from 0.01 to 40 weight % of the total weight of aluminum and graphite of the solid mixture and metal oxide in a range from 4 to 14 weight % of the total weight of aluminum, graphite and metal oxide of metal selected from Ti, Zr and aluminum of the solid mixture.

7. The fluorescent display device of claim 1, wherein the conductive layer is made by heat-treating a mixture of aluminum powder and graphite power.

8. The fluorescent display device of claim 7, wherein the aluminum powder has an average particle diameter within a range from 1 to 10 μm.

9. The fluorescent display device of claim 7, wherein the aluminum powder has an average particle diameter within a range from 2 to 5 μm.

10. The fluorescent display device of claim 7, wherein the graphite powder has an average particle diameter within a range from 1 to 5 μm.

11. The fluorescent display device of claim 7, wherein the graphite powder has an average particle diameter within a range from 2 to 4 μm.

12. The fluorescent display device of claim 1, wherein the conductive layer is formed of solid mixture containing aluminum, graphite, low-melting point glass, and metal oxide of metal selected from Ti, Zr and aluminum.

13. The fluorescent display device of claim 12, wherein the conductive layer is formed of the solid mixture which contains graphite in a range from 0.01 to 40 weight % of the total weight of aluminum and graphite of the solid mixture and low-melting point glass in a range from 0.01 to 30 weight % of the total weight of aluminum, graphite and low-melting point glass of the solid mixture.

14. The fluorescent display device of claim 12, wherein the conductive layer is formed of the solid mixture which contains graphite in a range from 0.01 to 40 weight % of the total weight of aluminum and graphite of the solid mixture and metal oxide in a range from 4 to 14 weight % of the total weight of aluminum, graphite and metal oxide of metal selected from Ti, Zr and aluminum of the solid mixture.

* * * * *